US005733717A

United States Patent [19]

Saeva et al.

[11] Patent Number: 5,733,717

[45] Date of Patent: Mar. 31, 1998

[54] SILVER HALIDE PHOTOGRAPHIC ELEMENTS CONTAINING ARYLIODONIUM COMPOUNDS

[75] Inventors: Franklin D. Saeva, Webster; Roger L. Klaus, Rochester; Jerzy Z. Mydlarz, Fairport, all of N.Y.

[73] Assignee: Eastman Kodak Company, Rochester, N.Y.

[21] Appl. No.: 779,538

[22] Filed: Jan. 8, 1997

[51] Int. Cl.[6] ..... G03C 1/035; G03C 1/08

[52] U.S. Cl. ..... 430/567; 430/569; 430/568; 430/599; 430/603; 430/605

[58] Field of Search ..... 430/567, 568, 430/569, 603, 605, 599

[56] References Cited

U.S. PATENT DOCUMENTS

| | | | |
|---|---|---|---|
| 2,105,274 | 1/1938 | Steigmann | 430/398 |
| 3,554,758 | 1/1971 | Willems et al. | 430/602 |
| 3,817,753 | 6/1974 | Willems et al. | 430/265 |
| 3,928,043 | 12/1975 | Ciurca, Jr. | 430/212 |
| 5,605,789 | 2/1997 | Chen et al. | 430/567 |

FOREIGN PATENT DOCUMENTS

| | | | |
|---|---|---|---|
| 1552027 | 9/1979 | United Kingdom | 430/357 |

*Primary Examiner*—Mark F. Huff
*Attorney, Agent, or Firm*—Sarah Meeks Roberts

[57] ABSTRACT

This invention relates to a silver halide photographic element comprising a silver halide emulsion precipitated and/or chemically sensitized in the presence of an aryliodonium compound represented by the formula:

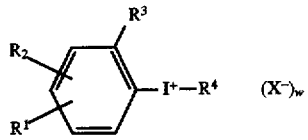

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

20 Claims, No Drawings

SILVER HALIDE PHOTOGRAPHIC ELEMENTS CONTAINING ARYLIODONIUM COMPOUNDS

FIELD OF THE INVENTION

This invention relates to the use of certain aryliodonium compounds as antifoggants in silver halide photographic elements and the preparation of silver halide emulsions containing such compounds.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog is usually expressed as "D-min", the density obtained in the unexposed portions of the emulsion. Density, as normally measured, includes both that produced by fog and that produced as a function of exposure to light. It is known in the art that the appearance of photographic fog can occur during many stages of preparation of the photographic element including silver halide emulsion preparation (which includes nucleation, growth, washing, and concentrating the emulsion), spectral/chemical sensitization of the silver halide emulsion, melting and holding of the liquid silver halide emulsion melts, mixing of the emulsion with coating aids and dye-forming couplers, subsequent coating of silver halide emulsions, and prolonged natural and artificial aging and storage of coated silver halide emulsions.

One form of fog, "reduction fog", originates from the reduction of ionic silver to metallic silver. If this metallic silver forms large enough particles associated with the silver halide crystal the particles are spontaneously developable. Intentional reduction sensitization is also sometimes employed to increase the sensitivity of silver halide grains, but if the particle size of the reduced silver is large enough, there is a similar increase in fog. One means of controlling reduction fog is with materials or conditions that oxidize the large metallic silver centers back to silver ions or to a size too small to spontaneously develop.

Several options are available in the art to facilitate the prevention of reduction fog. Thiosulfonic acids and their salts, as discussed in E.Ger. Patent 7376 (1952); F. Mueller, "The Photographic Image, Formation and Structure"; S. Kikuchi, Ed., Focal, London (1970); and U.S. Pat. No. 5,244,781 have been used during emulsion precipitation and sensitization, and during film formation to oxidize reduction fog. Inorganic oxidants such as mercuric salts, peroxides, persulfates, halogens, sulfur, and permanganates have been described in, for example, EP 0 576 920 A2; and U.S. Pat. Nos. 4,681,838 and 2,728,663 as oxidizing reduction fog, as have organic oxidants such as disulfides, halosuccinimides, or quinones in, for example, U.S. Pat. Nos. 5,219,721 and 4,468,454. All of these examples, and others, have their own limitations. Often fog restrainers have a negative impact on sensitometry, particularly speed. Other may react with dye-forming couplers or may be difficult to use. The use of mercuric salts, which have been universally used as fog restrainers because of their effectiveness, versatility and lack of secondary effects, is no longer desirable due to environmental concerns.

Consequently, despite the vast amount of effort which has gone into methods to control fog in photographic elements there is a continuing need in the industry for practical and environmentally benign stabilizers and fog preventers which do not otherwise adversely affect the performance of the photographic element. The inventors herein have discovered that organic aryliodonium carboxylates are particularly useful as fog restrainers for silver halide elements.

Diphenyliodonium salts have been described in U.S. Pat. Nos. 2,105,274 and 3,817,753 as silver halide development antifoggants and development modifiers. Diaryliodonium salts of mercuric halides have been described in U.S. Pat. No. 3,554,758 as silver halide fog inhibitors. Organic iodyl compounds are described in U.S. Pat. No. 3,928,043 as oxidants for leuco dyes, particularly in color diffusion transfer elements. Organic multivalent iodine compounds are described in GB 1,552,027 as intensifying agents when added to a photographic material or processing solutions for color silver halide materials. However, there is no suggestion in the art that aryliodonium compounds may be utilized as fog restrainers as described hereafter.

SUMMARY OF THE INVENTION

This invention provides a silver halide photographic element comprising a silver halide emulsion precipitated and/or chemically sensitized in the presence of an aryliodonium compound represented by the formula:

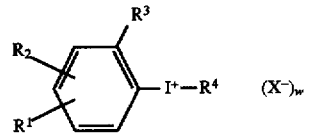

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$. In one embodiment the aryliodonium compound has been added at the start of or during precipitation of the silver halide emulsion.

The invention further provides a method of making a silver halide emulsion comprising precipitating and chemically sensitizing the emulsion and further comprising adding to the emulsion at any time before or during chemical sensitization an aryliodonium compound represented by above formula.

The silver halide photographic elements of this invention exhibit less reduction fog without a large loss of photographic speed. The aryliodonium compounds used in this invention can be used to replace mercuric salts and are themselves environmentally benign.

DETAILED DESCRIPTION OF THE INVENTION

The aryliodonium carboxylate compounds utilized in this invention are represented by the following formula:

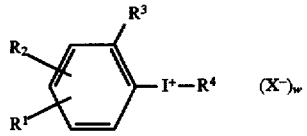

wherein $R^1$ and $R^2$ and $R^3$ can be any substituents which are suitable for use in a silver halide photographic element and which do not interfere with the fog restraining activity of the aryliodonium compound. $R^1$, $R^2$ and $R^3$ may be independently H, or a substituted or unsubstituted aliphatic, aromatic, or heterocyclic group or any two of $R^1$, $R^2$ and $R^3$ may together represent the atoms necessary to form a 5 or 6-membered ring or a multiple ring system. $R^1$, $R^2$ and $R^3$ may also be alkoxy groups (for example, methoxy, ethoxy, octyloxy), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acyloxy groups (for example, acetoxy, benzoxy), carboxyl groups, cyano groups, nitro groups, sulfo groups, alkylsulfoxide groups and trifluouroalkyl groups. In one preferred embodiment $R^1$, $R^2$ and $R^3$ are independently H, or aliphatic, aromatic or heterocyclic groups. In another preferred embodiment $R^1$ and $R^2$ are independently H, halogen atoms, or aliphatic, aromatic or heterocyclic groups and $R^3$ is a sulfo or carboxyl group.

When $R^1$, $R^2$ and $R^3$ are aliphatic groups, preferably, they are alkyl groups having from 1 to 22 carbon atoms, or alkenyl or alkynyl groups having from 2 to 22 carbon atoms. More preferably, they are alkyl groups having 1 to 10 carbon atoms, or alkenyl or alkynyl groups having 3 to 5 carbon atoms. Most preferably they are alkyl groups having 1 to 5 carbon atoms. These groups may or may not have substituents. Examples of alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms and include, among others, phenyl and naphthyl groups. More preferably, the aromatic groups have 6 to 10 carbon atoms and most preferably the aromatic groups are phenyl. These groups may be substituted or unsubstituted. The heterocyclic groups are 3 to 15-membered rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

Any one of $R^1$, $R^2$ and $R^3$ may together form a ring or multiple ring system. These ring systems may be unsubstituted or substituted. The ring and multiple ring systems formed by $R^1$, $R^2$ and $R^3$ may be alicyclic or they may be the aromatic and heterocyclic groups described above.

$R^4$ is a carboxylate salt such as acetate, formate, benzoate or trifluoroacetate, or other longer chain acids or $R^4$ is $0^-$. W is independently 0 or 1. When $R^3$ is a sulfo or carboxyl group w is 0 and $R^4$ is $0^-$.

$X^-$ is any anionic counter ion which is suitable for use in a photographic element and which does not interfere with the fog restraining effect of the compound. Preferably the counter ions are water soluble. Suitable examples of $X^-$ include $CH_3CO_2$, Cl, $CF_3SO_3$, $PF_6$, Br, $BF_4$, $AsF_6$, $CH_3SO_3$, $CF_3CO_2$, $CH_3C_6H_4SO_3$, $HSO_4$, $SbF_6$, and $CCl_3CO_2$. Particularly useful are $CH_3CO_2$, $CH_3SO_3$ and $PF_6$.

Nonlimiting examples of substituent groups for $R^1$, $R^2$ and $R^3$ and $R^4$ include alkyl groups (for example, methyl, ethyl, hexyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred substituents are lower alkyl groups, i.e., those having 1 to 4 carbon atoms (for example, methyl) and halogen groups (for example, chloro).

Specific examples of the aryliodonium compounds include, but are not limited to

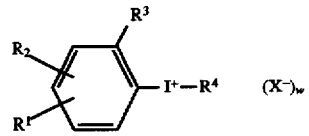

| Compound | $R^1$ | $R^2$ | $R^3$ | $R^4$ | W | X |
|---|---|---|---|---|---|---|
| 1 | H | H | H | $OCOCH_3$ | 1 | $OCOCH_3$ |
| 2 | H | H | H | $OCOCF_3$ | 1 | $OCOCF_3$ |
| 3 | H | $CH_3$ | H | $OCOCH_3$ | 1 | $OCOCH_3$ |
| 4 | H | $CH_3$ | $CO_2H$ | $O^-$ | 0 | — |
| 5 | H | H | $CO_2H$ | $O^-$ | 0 | — |
| 6 | H | CN | $CO_2H$ | $O^-$ | 0 | — |
| 7 | $OCH_3$ | $CH_3$ | H | $OCOCH_3$ | 1 | $OCOCH_3$ |
| 8 | $CH_3$ | $CH_3$ | $CH_3$ | $OCOCH_3$ | 1 | $OCOCH_3$ |
| 9 | $CH_3$ | $CH_3$ | H | $OCOCH_3$ | 1 | $OCOCH_3$ |
| 10 | H | H | H | OCOH | 1 | OCOH |
| 11 | H | $CH_3$ | H | OCOH | 1 | OCOH |
| 12 | $CH_3$ | $CH_3$ | $CO_2H$ | $O^-$ | 0 | — |
| 13 | H | H | $SO_3H$ | $O^-$ | 0 | — |
| 14 | H | CN | $CO_2H$ | $O^-$ | 0 | — |
| 15 | $OCH_3$ | Cl | H | $OCOCH_3$ | 1 | $OCOCH_3$ |

-continued

| Compound | $R^1$ | $R^2$ | $R^3$ | $R^4$ | W | X |
|---|---|---|---|---|---|---|
| 16 | $CO_2H$ | H | H | $OCOCH_3$ | 1 | $OCOCH_3$ |
| 17 | $OCH_3$ | Cl | $CH_3$ | $OCOCH_3$ | 1 | $OCOCH_3$ |
| 18 | H | H | H | $OCOCH_2CH_3$ | 1 | $OCOCH_2CH_3$ |
| 19 | H | $CH_2OH$ | H | $OCOCH_3$ | 1 | $OCOCH_3$ |
| 20 | Cl | $CH_2OH$ | $CO_2H$ | $O^-$ | 0 | — |
| 21 | Cl | $CH_3$ | $SO_3H$ | $O^-$ | 0 | — |
| 22 | $CH_3$ | CN | $CO_2H$ | $O^-$ | 0 | — |
| 23 | $CF_3$ | Cl | H | $OCOCH_3$ | 1 | $OCOCH_3$ |
| 24 | $CO_2H$ | H | H | $OCOCH_3$ | 1 | $OCOCH_3$ |
| 25 | $OCCH_3$ | H | $C_6H_5$ | $OCOCH_3$ | 1 | $OCOCH_3$ |
| 26 | $C_6H_5$ | H | H | $OCOCH_3$ | 1 | $OCOCH_2CH_3$ |
| 27 | $C_6H_4CO_2H$ | H | H | $OCOCH_3$ | 1 | $OCOCH_3$ |
| 28 | H | $CH_2OH$ | $CO_2H$ | $O^-$ | 0 | — |
| 29 | $SO_2CH_3$ | H | H | $OCOCH_3$ | 1 | $OCOCH_3$ |
| 30 | Cl | CN | $CO_2H$ | $O^-$ | 0 | — |
| 31 | $CF_3$ | $OCH_3$ | H | $OCOCH_3$ | 1 | $OCOCH_3$ |
| 32 | $CO_2H$ | $CO_2H$ | H | $OCOCH_3$ | 1 | $OCOCH_3$ |

Compounds 1, 2, 5, 10, 12, 16, 19, 24, 25, and 29 are examples of particularly suitable compounds for use in this invention.

The aryliodonium compounds are readily synthesized by reaction of the iodosoaryl compound and the corresponding anhydride as discussed in *Org. Syn.*, 1961 and in "Advanced Organic Chemistry," by Fieser & Fieser, Reinhold, N.Y., 1961 and as shown below:

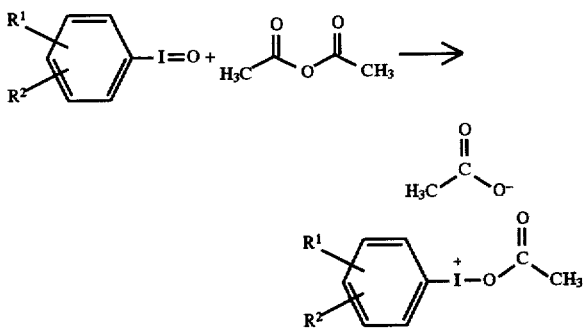

Many of these compounds are commercially available.

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention. Nonlimiting examples of suitable substituents are as described above for the substituent groups for $R^1$, $R^2$, $R^3$ and $R^4$.

Useful levels of the aryliodonium compounds range from about $1\times10^{-9}$ to $10\times10^{-3}$ mol/mol Ag. $10\times10^{-3}$ mol/mol Ag being the more preferred upper limit. The amount to be added is somewhat dependent on the point of addition. If the compound is added after precipitation preferred levels range from about $10\times10^{-7}$ to $1\times10^{-3}$ mol/mol Ag. If the aryliodonium compound is added at the start of or during precipitation the preferred range is from about $1\times10^{-9}$ to $1\times10^{-4}$ mol/mol Ag.

The aryliodonium compounds may be added to the photographic emulsion using any technique suitable for this purpose. They may be dissolved in most common organic solvents, for example, methanol or acetone. The compounds can be added to the emulsion in the form of a liquid/liquid dispersion similar to the technique used with certain couplers. They can also be added as a solid particle dispersion.

The aryliodonium compounds may be used in addition to any conventional emulsion stabilizer or antifoggant as commonly practiced in the art. Combinations of more than one aryliodonium compound may be utilized.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be any of those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The aryliodonium compounds may be added to the silver halide emulsion at any time before or during precipitation and/or chemical sensitization. They may be added before or during precipitation in an amount which will wash out before the heat treatment of chemical sensitization, or they may be added before or during precipitaion in an amount which will result in some of the aryliodonium compound being present during the heat treatment which completes chemical sensitization so that the emulsion is chemically sensitized in the presence of the compound. They may also be added at any time after precipitation and before or during the heat treatment employed to complete chemical sensitization so that the emulsion is chemically sensitized in the presence of the compound. They may also be added both before or during precipitation and before or during chemical sensitization so that the beneficial aspects of the compounds are available at all stages of precipitation and chemical sensitization. More preferably the compounds are added at the start of or during precipitation of the emulsion.

The silver halide emulsions utilized in this invention may be comprised of any halide distribution. Thus, they may be comprised of silver bromoiodide, silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions.

The silver halide emulsions can contain grains of any size and morphology. Thus, the grains may take the form of cubes, octahedrons, cubo-octahedrons, or any of the other naturally-occurring morphologies of cubic lattice type silver halide grains. Further, the grains may be irregular such as spherical grains or tabular grains. Grains having a tabular or cubic morphology are preferred.

The aryliodonium compounds are useful with intentionally or unintentionally reduction sensitized emulsions. As described in *The Theory of the Photographic Process*, Fourth Edition, T. H. James, Macmillan Publishing Company, Inc., 1977 pages 151–152, reduction sensitization has been known to improve the photographic sensitivity of silver halide emulsions. Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The aryliodonium compounds are also particularly useful with emulsions doped with group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire P010 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

The photographic elements suitable for use with this invention may be simple single layer elements or multilayer, multicolor elements. They may also be black and white elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art. The silver halide elements may be reversal or negative elements, or transmission or reflection elements (including color paper).

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, Published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, and (3) *Research Disclosure*, September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating |
| 3 | I, II, III, IX A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Wash-out |
| 3 | X | couplers; Dye stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment.

The following examples illustrate the practice of this invention. They are not intended to be exhaustive of all possible variations of the invention.

EXAMPLES

Example 1

In a 4-liter reaction vessel was placed an aqueous gelatin solution (composed of 1 liter of water, 0.83 g of oxidized alkali-processed gelatin, 4.2 mL of 4N nitric acid solution, 1.12 g of sodium bromide and having pAg of 9.39, and 14.77 wt %, based on total silver used in nucleation, of PLURONIC TM-31R1 surfactant) and while keeping the temperature thereof at 45° C., 5.33 mL of an aqueous solution of silver nitrate (containing 0.72 g of silver nitrate) and an equal amount of an aqueous solution of sodium bromide (containing 0.46 g of sodium bromide) were simultaneously added thereto over a period of 1 minute at a constant rate. Then, into the mixture was added 14.2 mL of an aqueous sodium bromide solution (containing 1.46 g of sodium bromide) after 1 minute of mixing. The temperature of the mixture was raised to 60° C. over a period of 9 minutes. At that time, 43.3 mL of an aqueous ammoniacal solution (containing 3.36 g of ammonium sulfate and 26.7 mL of 2.5N sodium hydroxide solution) was added into the vessel and mixing was conducted for a period of 9 minutes. Then, 177 mL of an aqueous gelatin solution (containing 16.7 g of oxidized alkali-processed gelatin, 10.8 mL of 4N nitric acid solution and 0.11 g of Pluronic TM-31R1 surfactant) was added to the mixture over a period of 2 minutes. Next, 7.5 mL of an aqueous silver nitrate solution (containing 1.02 g of silver nitrate) and 7.7 mL of an aqueous sodium bromide solution (containing 0.66 g of sodium bromide) were added at a constant rate for a period of 5 minutes. Then, 474.7 mL of an aqueous silver nitrate solution (containing 129 g of silver nitrate) and 474.1 mL of an aqueous sodium bromide solution (containing 82 g of sodium bromide) were simultaneously added to the aforesaid mixture at constant ramp starting from a respective rate of 1.5 mL/min and 1.62 mL/min for the subsequent 64 minutes. Then, 253.3 mL of an aqueous silver nitrate solution (containing 68.8 g of silver nitrate) and 251.1 mL of an aqueous sodium bromide solution (containing 43.4 g of sodium bromide) were simultaneously added to the aforesaid mixture at a constant rate over a period of 19 minutes. The silver halide emulsion thus obtained was washed.

The emulsion was then chemically sensitized with optimum levels of conventional sulfur and gold sensitizers (EM-1). To induce reduction fog another sample of the emulsion was first treated with an amine borane compound and then given an identical sulfur and gold sensitization (EM-2). This treatment with amine borane generates the same type and level of fog due to small metallic silver centers that is produced during precipitation by intentional, adventitious, or inherent reductants. An aryliodonium carboxylate of this invention, iodobenzene diacetate (Compound 1) (IBDA) (CAS Reg No. 3240-34-4), was compared against diphenyliodonium chloride (DPIC) (CAS Reg No. 1483-72-3) described in U.S. Pat. No. 2,105,274 and a mercuric salt (Hg) (CAS Reg No. 63325-16-6). Each compound was added to a separate portion of EM-2 by addition to the emulsion between the amine borane treatment and the subsequent sulfur and gold sensitization. Conventional antifoggants like tetraazaindene (TAI) (CAS Reg No. 38299-08-0) and phenylmercaptotetrazole (PMT) (CAS Reg No. 86-93-1) were likewise added to the amine borane treated emulsion. The emulsions were then diluted with gelatin, water, and coating aids and cast onto a blue-tinted cellulose acetate support. The emulsion layers were then hardened with an overcoat containing gelatin, water, coating aids, and a vinylsulfone hardener. The resulting dried coatings were exposed for 0.02 seconds with white light and developed in Kodak RP X-OMAT. Table 1 shows the minimum density (D-min) and Relative Speeds of the emulsion coatings.

TABLE 1

| Description | Compound | Level (μmol/Ag mol) | Relative Speed | D-min |
|---|---|---|---|---|
| EM-1 (control) | none | | 100 | 0.055 |
| EM-2 (control) | none | | 214 | 0.686 |
| Comparison | Hg | 0.1 | 97 | 0.055 |
| Comparison | Hg | 0.5 | 58 | 0.043 |
| Comparison | DPIC | 10 | 151 | 0.344 |
| Comparison | DPIC | 1000 | 82 | 0.314 |
| Comparison | TAI | 1 | 240 | 0.319 |
| Comparison | TAI | 100 | 251 | 0.471 |
| Comparison | TAI | 1000 | 10.7 | 1.131 |
| Comparison | PMT | 1 | 246 | 0.316 |
| Comparison | PMT | 100 | 282 | 0.356 |
| Comparison | PMT | 1000 | 63 | 0.652 |
| Invention | IBDA | 10 | 178 | 0.328 |
| Invention | IBDA | 100 | 95 | 0.054 |
| Invention | IBDA | 1000 | 76 | 0.042 |

The results in Table 1 show that an aryliodonium carboxylate of this invention can reverse reduction fog to a position equivalent to that obtained by a mercuric salt. The reduction fog can be eliminated so that the photographic response of the desired non-reduction fogged emulsion is achieved without a significant loss in sensitivity. Additionally, the closely related diphenyliodonium chloride failed to diminish fog density, yet caused a significant loss in sensitivity. The conventional antifogging tetraazaindene and phenylmercaptotetrazole also failed to diminish the fog despite their known utility as fog retrainers after emulsion sensitization.

Example 2

A portion of the same emulsion (EM-1) used in Example 1 was again treated with amine borane and then given sulfur and gold sensitization (EM-2A). DPIC and diphenyliodonium acetate (DPIAc) (CAS Reg No. 13190-17-1) were compared to IBDA to compare the effect of the counterion in the same manner as the compounds in Example 1. These results are shown in Table 2.

TABLE 2

| Description | Compound | Level (μmol/Ag mol) | Relative Speed | D-min |
|---|---|---|---|---|
| EM-1 (control) | none | | 100 | 0.049 |
| EM-2A (control) | none | | 178 | 0.155 |
| Comparison | DPIC | 10 | 166 | 0.182 |
| Comparison | DPIC | 50 | 155 | 0.129 |
| Comparison | DPIC | 100 | 148 | 0.168 |
| Comparison | DPIC | 500 | 105 | 0.139 |
| Comparison | DPIAc | 1 | 178 | 0.13 |
| Comparison | DPIAc | 50 | 178 | 0.165 |
| Comparison | DPIAc | 100 | 162 | 0.102 |
| Comparison | DPIAc | 500 | 112 | 0.178 |
| Invention | IBDA | 10 | 145 | 0.087 |
| Invention | IBDA | 50 | 91 | 0.057 |
| Invention | IBDA | 100 | 91 | 0.052 |
| Invention | IBDA | 500 | 68 | 0.047 |

The results in Table 2 show that the acetate ion associated with IBDA is not the source of the fog reduction since acetate ion on diphenyliodonium ion gives an effect no different than chloride ion on diphenyliodonium ion.

Example 3

Emulsion A

A pure chloride silver halide emulsion was precipitated by equimolar addition of silver nitrate and sodium chloride into a well stirred reactor containing gelatin peptizer and an antifoaming pluronic agent. The reaction vessel contained 4.5 L of a solution that was 7.9% in oxidized gelatin, 0.038M in NaCl and contained 1.8 g of antifoamant. The contents of the reaction vessel were maintained at 55° C. and the pCl was adjusted to 1.7. To this stirred solution at 55° C. 27.7 mL of a solution 2.6M in $AgNO_3$ and 26.9 mL of a solution 2.8M in NaCl were added simultaneously at 27.7 mL/min for 1 minute.

Then the 2.6M silver nitrate solution and the 2.8M sodium chloride solution were added simultaneously with a ramped linearly increasing flow from 27.7 mL/min to 123 mL/min over 20 minutes. The 2.6M silver nitrate solution and 2.8M sodium chloride solution were then added simultaneously at 123 mL/min for 40 minutes. The emulsion was cooled down to 40° C. over 5 minutes. The resulting emulsion was a cubic grain silver chloride emulsion of 0.4 μm in edgelength. The emulsion was then washed using an ultrafiltration unit, and final pH and pCl were adjusted to 5.6 and 1.7, respectively.

Emulsion B

Emulsion B was prepared in the same manner as Emulsion A except that the 2.6M silver nitrate solution contained $3\times10^{-7}$ mole of mercuric chloride per mole of silver.

Emulsion C

Emulsion C was prepared in the same manner as Emulsion A except that the 2.6M silver nitrate solution contained $7.5\times10^{-5}$ mole of IBDA per mole of silver.

Emulsions A through C were melted at 40° C. and then sensitized by the addition of the optimum amount of green sensitizing dye of the structure shown below, followed by addition of the optimum amount of colloidal gold-sulfide followed by a heat ramp up to 60° C. then hold for 45 minutes. Then the emulsion was cooled down to 40° C. and 1-(3-acetamidophenyl)-5-mercaptotetrazole was added followed by the addition of potassium bromide. All Emulsions A through C were coated at 26 mg silver per square foot (or 280 mg $Ag/m^2$) along with Coupler I on resin-coated paper support. The coatings were overcoated with a gelatin layer and the entire coating was hardened with bis (vinylsulfonylmethyl)ether.

The coatings were exposed through a step wedge with a 3000K tungsten source at an exposure time of 0.10 seconds. All coatings were processed in KODAK™ Ektacolor RA-4.

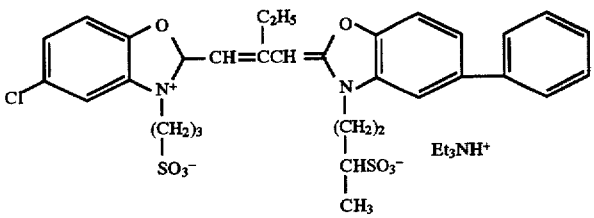

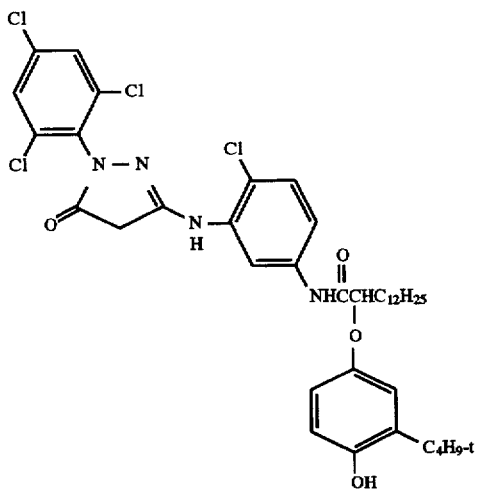

TABLE 3

| Emulsion | $D_{min}$ | Speed @ D = 1.0 | TOE | LOTOE | SHLDR | CONTR |
|---|---|---|---|---|---|---|
| A | 0.307 | 213 | 0.54 | 0.40 | 1.72 | 152 |
| B | 0.201 | 221 | 0.46 | 0.29 | 1.86 | 180 |
| C | 0.204 | 225 | 0.45 | 0.29 | 1.89 | 182 |

The results in Table 3 again show that an aryliodonium carboxylate of this invention can reverse reduction fog to a position equivalent to that obtained by a mercuric salt and that such a reduction can be achieved when the aryliodonium compound is added during precipitation.

The coatings of emulsions A through C were also exposed through a step wedge with 3000K tungsten source at a high-intensity short exposure time of $10^{-4}$ second and long exposure time of $10^{-2}$ second. The total energy of each exposure was kept at a constant level. Speed is reported as 10.0× the relative log speed at the specified level above the minimum density. In these relative speed units a speed difference of 30, for example, is a difference of 0.30 logE, where E is exposure in lux-seconds. These exposures will be referred to as "Optical Sensitivity" in the following table.

These coatings were also exposed with a laser sensitometer at 543 nm, a resolution of 250 pixels/inch, a pixel pitch of 50.8 μm, and an exposure time of 1 microsecond per pixel. These exposures will be referred to as "Digital Sensitivity" in the following table.

TABLE 4

| | Optical Sensitivity | | | | Digital Sensitivity | |
|---|---|---|---|---|---|---|
| | $10^{-2}$ sec exposure | | $10^{-4}$ sec exposure | | $1 \times 10^{-6}$ sec exposure | |
| Emulsion | Dmin + 0.15 | Dmin + 1.95 | Dmin + 0.15 | Dmin + 1.95 | Dmin + 0.15 | Dmin + 1.95 |
| A | 155 | 100 | 153 | 95 | 200 | 100 |
| B | 152 | 113 | 151 | 101 | 204 | 113 |
| C | 158 | 116 | 158 | 107 | 217 | 122 |

Example 4

A cubic grain silver chloride emulsion was prepared as described by Example 3. This emulsion, Emulsion D, was utilized in Examples 4a and 4b. The emulsion was optimally sensitized by the customary technique (known in the art) using the magenta and cyan finish format. In each finish, the sequence of chemical sensitizer, spectral sensitizer, Lippmann silver bromide and antifoggants addition are the same. There were, however, two significantly different sensitization classes: gold-sulfide and gold(I)-plus-sulfur. Detailed procedures are described in the EXAMPLES below.

The magenta-sensitized emulsions were sensitized with magenta sensitizing dye SS-1. Just prior to coating on resin coated paper support the magenta sensitized emulsions were dual-mixed with magenta dye forming coupler; Coupler I.

The red-sensitized emulsions were sensitized with red sensitizing dye; Dye SS-2. Just prior to coating on resin coated paper support the cyan sensitized emulsions were dual-mixed with cyan dye forming coupler; Coupler 2.

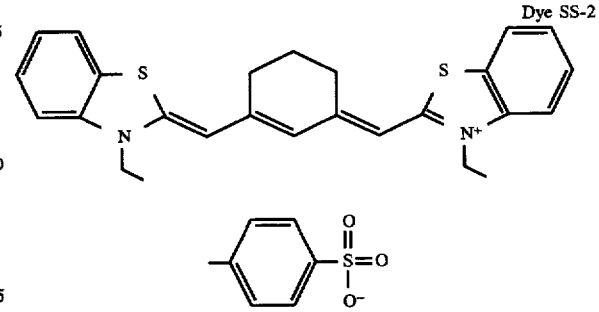

-continued

Coupler 2

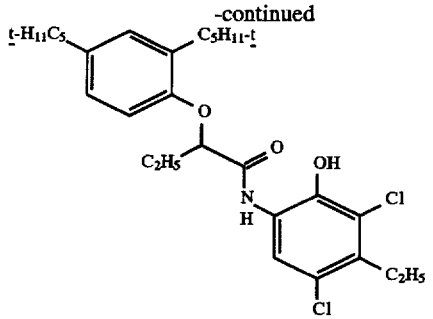

The magenta sensitized emulsions were coated at 26 mg silver per square foot while the cyan sensitized emulsions were coated at 17 mg silver per square foot on resin-coated paper support. The coatings were overcoated with a gelatin layer and the entire coating was hardened with bis (vinylsulfonylmethyl)ether.

The coatings were exposed through a step wedge with 3000K tungsten source at exposure time of 0.10 second. All coatings were processed in KODAK™ Ektacolor RA-4 processing.

Example 4a

This example compares pure silver chloride cubic emulsions sensitized in the presence of iodobenzene diacetate for the magenta color record. The sensitization details were as follows:

Parts 1.1: A portion of silver chloride Emulsion D was optimally sensitized by the addition of the optimum amount of green sensitizing dye (SS-1) followed by addition of the optimum amount of colloidal gold-sulfide followed by heat ramp up to 60° C. for 45 minutes. The emulsion was cooled down to 40° C. and 1-(3-acetamidophenyl)-5-mercaptotetrazole was added followed by addition of Lippmann silver bromide.

Parts 1.2: A portion of silver chloride Emulsion D was sensitized identically as in Part 1.1 except that 2 mg of iodobenzene diacetate/Ag mole was added as the first addendum in the finish.

Parts 1.3: A portion of silver chloride Emulsion D was sensitized identically as in Part 1.1 except that 10 mg of iodobenzene diacetate/Ag mole was added as the first addendum in the finish.

Parts 1.4: A portion of silver chloride Emulsion D was sensitized identically as in Part 1.1 except that 25 mg of iodobenzene diacetate/Ag mole was added as the first addendum in the finish.

Parts 1.5: A portion of silver chloride Emulsion D was sensitized identically as in Part 1.1 except that 35 mg of iodobenzene diacetate/Ag mole was added as the first addendum in the finish.

Parts 1.6: A portion of silver chloride Emulsion D was sensitized identically as in Part 1.1 except that 50 mg of iodobenzene diacetate/Ag mole was added as the first addendum in the finish.

Sensitometric data are summarized in Table 5.

TABLE 5

| Coating Part | IBDA mg/Ag mol | Dmin | SPEED | LOTOE | SHLDR | CONTR |
|---|---|---|---|---|---|---|
| 1.1 | — | 0.180 | 215 | 0.46 | 1.84 | 180 |
| 1.2 | 2 | 0.158 | 217 | 0.44 | 1.85 | 186 |
| 1.3 | 10 | 0.148 | 217 | 0.43 | 1.87 | 190 |
| 1.4 | 25 | 0.141 | 217 | 0.43 | 1.84 | 188 |
| 1.5 | 35 | 0.140 | 218 | 0.43 | 1.85 | 189 |
| 1.6 | 50 | 0.140 | 218 | 0.43 | 1.86 | 189 |

Gold-sulfide sensitized unripened silver chloride cubic emulsions exhibit some beneficial effect of iodobenzene diacetate incorporation into the grain surface during sensitization in the magenta finish format. The presence of iodobenzene diacetate in the gold-sulfide magenta sensitization significantly reduces fresh fog without any other changes of photographic parameters.

Example 4b

This example compares unripened pure silver chloride cubic emulsions made in oxidized gelatin and sensitized in the presence of iodobenzene diacetate for the cyan color record. The sensitization details were as follows:

Parts 2.1: A portion of silver chloride Emulsion D was optimally sensitized by the addition of the optimum amount of stilbene followed by heat ramp up to 65° C. The emulsion was held at 65° C. for 10 minutes, and then Lippmann silver bromide was added followed by the optimum amount of soluble gold(I) sensitizer. Subsequently an optimum amount of sulfur-sensitizer was added followed by the addition of cyan spectral sensitizing dye (SS-2) followed by addition of 1-(3-acetamidophenyl)-5-mercaptotetrazole. The emulsion was cooled down to 40° C.

Parts 2.2: A portion of silver chloride Emulsion D was sensitized identically as in Part 2.1 except that 2 mg of iodobenzene diacetate/Ag mole was added as the first addendum in the finish.

Parts 2.3: A portion of silver chloride Emulsion D was sensitized identically as in Part 2.1 except that 10 mg of iodobenzene diacetate/Ag mole was added as the first addendum in the finish.

Parts 2.4: A portion of silver chloride Emulsion D was sensitized identically as in Part 2.1 except that 25 mg of iodobenzene diacetate/Ag mole was added as the first addendum in the finish.

Parts 2.5: A portion of silver chloride Emulsion D was sensitized identically as in Part 2.1 except that 35 mg of iodobenzene diacetate/Ag mole was added as the first addendum in the finish.

Parts 2.6: A portion of silver chloride Emulsion D was sensitized identically as in Part 2.1 except that 50 mg of iodobenzene diacetate/Ag mole was added as the first addendum in the finish.

The sensitometric data are summarized in Table 6.

TABLE 6

| Coating Part | IBDA mg/Ag mol | Dmin | SPEED | LOTOE | SHLDR | CONTR |
|---|---|---|---|---|---|---|
| 2.1 | — | 0.271 | 204 | 0.54 | 1.80 | 152 |
| 2.2 | 2 | 0.218 | 204 | 0.51 | 1.91 | 163 |

TABLE 6-continued

| Coating Part | IBDA mg/Ag mol | Dmin | SPEED | LOTOE | SHLDR | CONTR |
|---|---|---|---|---|---|---|
| 2.3 | 10 | 0.200 | 198 | 0.49 | 1.90 | 169 |
| 2.4 | 25 | 0.184 | 201 | 0.49 | 1.91 | 170 |
| 2.5 | 35 | 0.174 | 202 | 0.48 | 1.95 | 173 |
| 2.6 | 50 | 0.176 | 200 | 0.48 | 1.90 | 169 |

The use of iodobenzene diacete in gold(I)-plus-sulfur sensitized unripened pure silver chloride cubic emulsions provides some beneficial effect of iodobenzene diacetate incorporation into the grain surface during sensitization in the cyan finish format. The presence of iodobenzene diacetate in the gold(I)-plus-sulfur cyan sensitization significantly reduces fresh fog and increases contrast. All other photographic parameters are not affected by the presence of iodobenzene diacetate in the cyan gold(I)-plus-sulfur finish format.

The invention has been described in detail with particular reference to the preferred embodiments thereof, but it will be understood that variations and modifications can be effected within the scope of the invention.

What is claimed is:

1. A silver halide photographic element comprising a silver halide emulsion precipitated and/or chemically sensitized in the presence of an aryliodonium compound represented by the formula:

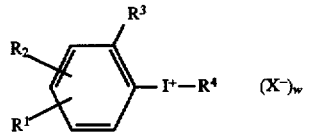

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

2. The photographic element of claim 1 wherein $R^1$, $R^2$ and $R^3$ are independently H, halogen atoms, or aliphatic, aromatic or heterocyclic groups.

3. The photographic element of claim 2 wherein $R^1$, $R^2$ and $R^3$ are independently H, an alkyl group having 1 to 10 carbon atoms or an aryl group having 6 to 10 carbon atoms.

4. The photographic element of claim 1 wherein $R^1$ and $R^2$ are independently H, halogen atoms, or aliphatic, aromatic or heterocyclic groups and $R^3$ is a sulfo or carboxyl group.

5. The photographic element of claim 4 wherein $R^1$ and $R^2$ are independently H, an alkyl group having 1 to 10 carbon atoms or an aryl group having 6 to 10 carbon atoms.

6. The photographic element of claim 1 wherein $R^4$ is acetate, formate, benzoate or trifluoroacetate.

7. The photographic element of claim 1 wherein the concentration of the aryliodonium compound is from $1\times10^{-9}$ to $10\times10^{-3}$ mol/mol Ag.

8. The photographic element of claim 7 wherein the silver halide emulsion is chemically sensitized in the presence of the aryliodonium compound and the concentration of the aryliodonium compound is from $10\times10^{-7}$ to $1\times10^{-3}$ mol/mol Ag.

9. The photographic element of claim 1 wherein the silver halide emulsion is precipitated in the presence of the aryliodonium compound.

10. The photographic element of claim 9 wherein the concentration of the aryliodonium compound is from $1\times10^{-9}$ to $1\times10^{-4}$ mol/mol Ag.

11. A method of making a silver halide emulsion comprising precipitating and chemically sensitizing the emulsion and further comprising adding to the emulsion at any time before or during chemical sensitization an aryliodonium compound represented by the formula:

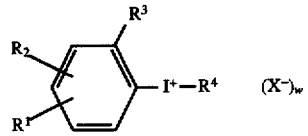

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

12. The method of claim 11 wherein $R^1$, $R^2$ and $R^3$ are independently H, halogen atoms, or aliphatic, aromatic or heterocyclic groups.

13. The method of claim 12 wherein $R^1$, $R^2$ and $R^3$ are independently H, an alkyl group having 1 to 10 carbon atoms or an aryl group having 6 to 10 carbon atoms.

14. The method of claim 11 wherein $R^1$ and $R^2$ are independently H, halogen atoms, or aliphatic, aromatic or heterocyclic groups and $R^3$ is a sulfo or carboxyl group.

15. The method of claim 14 wherein $R^1$ and $R^2$ are independently H, an alkyl group having 1 to 10 carbon atoms or an aryl group having 6 to 10 carbon atoms.

16. The method of claim 11 wherein $R^4$ is acetate, formate, benzoate or trifluoroacetate.

17. The method of claim 11 wherein the concentration of the aryliodonium compound is from $1\times10^{-9}$ to $10\times10^{-3}$ mol/mol Ag.

18. The method of claim 17 wherein the aryliodonium compound is added after precipitation and the concentration of the aryliodonium compound is from $10\times10^{-7}$ to $1\times10^{-3}$ mol/mol Ag.

19. The method of claim 11 wherein the aryliodonium compound is added at the start of or during precipitation of the silver halide emulsion.

20. The method of claim 19 wherein the concentration of the aryliodonium compound is from $1\times10^{-9}$ to $1\times10^{-4}$ mol/mol Ag.

* * * * *